United States Patent [19]

Stultz

[11] Patent Number: 5,042,017

[45] Date of Patent: Aug. 20, 1991

[54] ROTARY PULSE SWITCH

[75] Inventor: Peter F. Stultz, Elgin, Ill.

[73] Assignee: Digital Appliance Controls, Inc., Elgin, Ill.

[21] Appl. No.: 465,344

[22] Filed: Jan. 16, 1990

[51] Int. Cl.[5] ..... G04B 29/00; H01H 19/60

[52] U.S. Cl. ..... 368/187; 368/321; 200/11 R; 200/6 R; 307/106

[58] Field of Search ..... 368/69–71, 368/184–189, 319–321; 200/5 R, 6 R, 6 B, 6 BB, 11 R, 11 TW, 564, 568, 570, 573, 574; 307/106, 107; 341/17, 20, 34, 35, 190

[56] References Cited

U.S. PATENT DOCUMENTS

| | | | |
|---|---|---|---|
| 4,336,609 | 6/1982 | Kume et al. | 368/188 |
| 4,348,753 | 9/1982 | Werner et al. | 368/188 |
| 4,349,900 | 9/1982 | Alzawa | 368/187 |
| 4,419,018 | 12/1983 | Metrat | 368/69 |
| 4,449,832 | 5/1984 | Kammerer | 368/187 |
| 4,504,706 | 3/1985 | Watamabe et al. | 200/11 R |
| 4,600,316 | 7/1986 | Besson | 368/187 |
| 4,801,814 | 1/1989 | Rose et al. | 307/106 |

*Primary Examiner*—Vit W. Miska
*Attorney, Agent, or Firm*—Douglas B. White

[57] ABSTRACT

An apparatus for generating a digital pulse train from a dial rotation indicating the direction and degree of rotation. The device incorporates two facing disks mounted to a stem and having mating teeth on adjacent surfaces. One disk is mounted for free rotation about the winding stem and projects an actuating lever arm from its periphery. The other disk is mounted for axial movement and is keyed to rotate with the shaft. Left and right micro-switches are mounted proximate the disks and positioned to be contacted by the actuating lever when it is rotated in the respective left and right directions. During this rotation the stem moves the keyed disk in the selected direction of rotation. The keyed disk engages the free disk and causes it to rotate until the actuating lever arm contacts a micro-switch. When such contact occurs, the free disk is prevented from further rotation and the keyed disk shifts over the teeth of the free disk. This shifting repetition causes the lever arm to be periodically forced against the micro-switch to cause periodic switching during stem rotation.

7 Claims, 1 Drawing Sheet

ROTARY PULSE SWITCH

BACKGROUND OF THE INVENTION

1. Field of the Invention

The present invention relates generally to time setting devices, and more particularly to rotatable encoders. Such devices are used to convert a dial rotation to a digital representation for use with digital circuitry.

2. Description of the Prior Art

In electronic time pieces and timers, mechanical and electrical time selection and setting systems have been proposed. One of such systems is represented by U.S. Pat. No. 4,336,609 wherein a piezoelectric arm is flexed by a rotating element to develop pulses relating to the rotation. A discriminating circuit is used to determine which direction the rotation occurred. Another version is presented in U.S. Pat. No. 4,449,832 in which a rotary dial controls a disk having spaced slits. An opto-electronic device detects the passage of the slits to generate the data, but rotation direction is not detected. In U.S. Pat. No. 4,4198,018 there is presented an electro-mechanical device which operates switches in response to dial rotation. This device discriminates between direction of rotation by use of phase differences between two generated pulse trains. A winding stem is fitted with two cams, each cam being phase displaced with respect to the other. These cams operate to contact and flex resilient electrically conductive members to thereby produce phase shifted pulse trains.

SUMMARY OF THE INVENTION

The present invention incorporates two disks mounted on a rotatable stem and having radial teeth presented on their facing surfaces. One disk is mounted for free rotation about the winding stem and projects an actuating lever arm radially from its periphery. The other disk is mounted to allow axial motion on the stem but is keyed to rotate with the stem. This keyed disk is urged against the free disk by spring means. Left and right micro-switches are positioned to be contacted by the actuating lever when it is rotated in the respective direction. During this rotation the stem causes the keyed disk to rotate in the selected direction of rotation, and the keyed disk engages the free disk to cause it to move until the actuating lever arm contacts a micro-switch. When such contact occurs, the free disk is prevented from further rotation and the keyed disk slides upwardly on the teeth and shifts by one tooth location. When the shift occurs, the pressure exerted by the keyed disk causes the free disk to momentarily counter-rotate and un-switch the micro-switch. This shifting repetition causes the lever arm to periodically operate the micro-switch to cause periodic electrical pulses during stem rotation. BRIEF DESCRIPTION OF THE DRAWINGS FIG. 1 is an exploded perspective view of the preferred embodiment of the rotary switch of the present invention.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
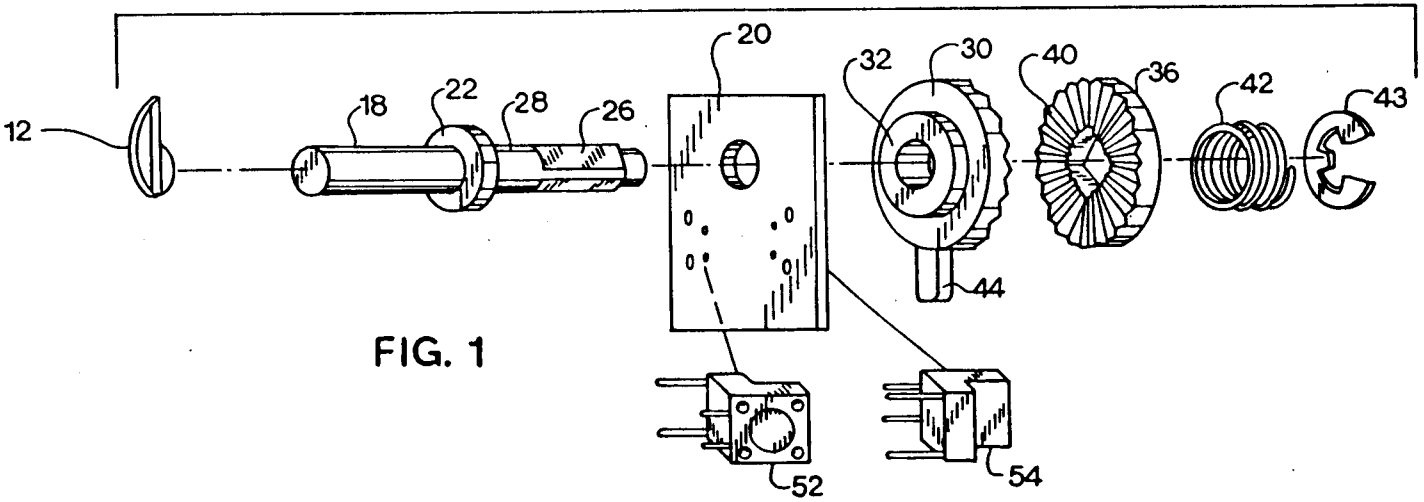

Turning first to FIG. 1 there is shown a digital timer setting device in accordance with the invention. For operating the device there is provided a dial 12 for selecting and indicating the desired time. This dail is affixed to a stem 18 arranged to protrude through a plate 20 and rotate against the plate at the stem collar 22. The portion of the stem protruding through the base comprises a keyed portion 26 and an un-keyed portion 28.

A first disk 30 is mounted for free rotation on the un-keyed portion of the stem and is thereby free to rotate against the base plate at its collar 32. A second disk 36 is fitted to the keyed portion of the stem and is thereby constrained to rotate with the stem. This keyed relationship consists of a non-round shaft fitted within a matching opening in the disk. Axial motion of the disk is thereby allowed while it is constrained to rotate with the shaft.

The disks engage one another by a gear arrangement. They are mounted to face against each other and are provided with radial teeth 40 on the facing surfaces. Each tooth is formed with smooth sloping sides and presents a fine edge. The teeth are distributed about the faces of each disk in a mating symmetrical pattern. Consequently, when the keyed disk is urged toward the free disk, by spring 42 acting against the retaining ring 43, the keyed disk will engage the free disk and cause it to rotate.

Figure 4:
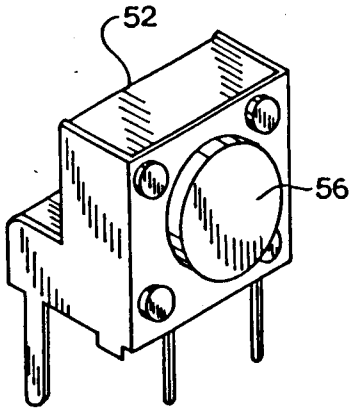
FIG. 4 is a perspective view of the micro-switch employed in the present invention.

Protruding radially from the periphery of the free disk is an actuating lever arm 44 arranged to sweep a path proximate to the disks. Mounted on the plate in this path, and in opposing relation, are two micro-switches 52 and 54. These switches are of the type shown in FIG. 4 and are positioned near the actuating arm such that the arm can strike the switch operating push button 56. When the free disk and actuating lever arm are rotated to the left, the button on the left switch is contacted by the lever arm. When the free disk and actuating lever arm are rotated to the right, the button on the right switch is contacted by the lever arm.

Figure 3:
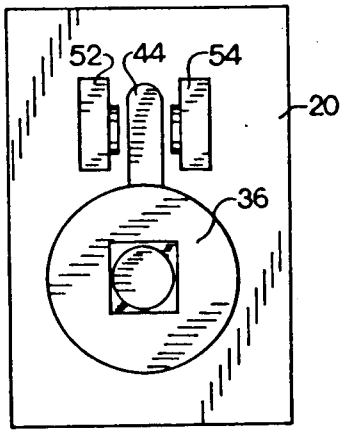
FIG. 3 is a top view of the assembled switch of FIG. 1 showing the relation of the actuating arm and the micro-switches.
Figure 2:
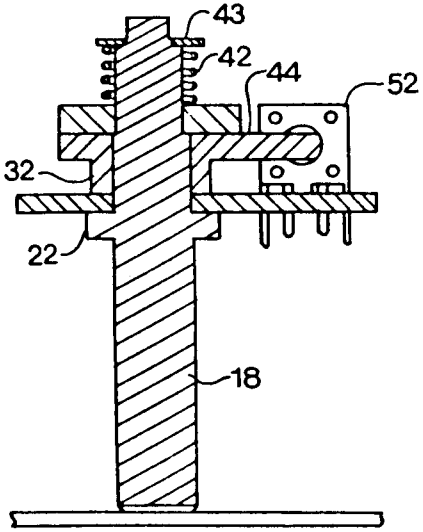
FIG. 2 is a sectional view of the assembled switch of FIG. 1.

With the free disk actuating arm starting as positioned in FIG. 3, the dial and stem may be turned (clockwise or counter-clockwise) to the selected dial position. During this turn the keyed disk rotates with the stem and initially engages the free disk. As the free disk rotates, the actuating lever arm comes into contact with a micro-switch and causes a momentary operation thereof. Since the switch obstructs further movement, the keyed disk rides up on the sloping sides of the radial teeth until it reaches the crest. Since the keyed disk is urged toward the free disk, rotation beyond the crest allows the spring on the keyed disk to force the free disk to slightly counter-rotate as the teeth again mate. During this counter rotation the micro-switch un-switches. Continued rotation of the dail in one direction establishes repetitions of this action and thereby repetitions of the switching. Rotation in an opposite direction produces similar switching from the other micro-switch. Electrical connection to the micro-switches yields a pulse train responsive to both the degree of rotation and the direction of rotation of the dial.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A digital input device comprising:

a rotatable shaft;

a free disk member having radial teeth defined on one face thereof mounted for free rotation about said shaft;

a keyed disk member having radial teeth defined on one face thereof mounted to said shaft adjacent to said free disk member and arranged to slide axially along said shaft but constrained to rotate with said shaft, said keyed disk member being oriented to present said radial teeth toward said free disk member;

means for urging said keyed disk member into a mating relation with said free disk member to cause said free disk member to rotate with said keyed disk member when the rotation of said free disk member is unimpeded, but to allow said keyed disk member to slip incrementally relative to said free disk member when the rotation of said free disk member is impeded; and electrical sensing means for sensing the movement of free disk member and generating an electrical signal therefrom.

2. The digital input device of claim 1 further comprising an actuating arm affixed to said free disk member, and wherein said electrical sensing means is arranged to sense the movement of said actuating arm.

3. The digital input device of claim 2 wherein said shaft member is mounted to extend through a plate member, and said electrical means comprises switch means mounted to said plate member and positioned to be operated by said actuating arm.

4. The digital input device of claim 3 wherein said actuating arm protrudes radially from the periphery of said free disk.

5. The digital input device of claim 4 wherein said switch means comprises two push-button operable switches mounted in opposing relation proximate said actuating arm.

6. A digital input device comprising:

a rotatable shaft;

motion indicating means for producing incremental motion in response to said shaft rotation comprising a first gear member having an actuating arm affixed thereto, a second gear member arranged to move in response to said shaft movement and positioned to drive said first gear member, and means for allowing said gear members to slip when the movement of said actuating arm is impeded; and signal generating means for sensing said incremental motion of said actuating arm of said motion indicating means and generating an electrical digital signal corresponding thereto.

7. The digital input device of claim 6 wherein said signal generating means comprises switch means positioned to be operated by said actuating arm.

* * * * *